US006685115B1

(12) United States Patent
Hardin

(10) Patent No.: US 6,685,115 B1
(45) Date of Patent: Feb. 3, 2004

(54) MOVABLE SPRAY NOZZLE MECHANISM

(76) Inventor: Daniel D. Hardin, 30924 W. Hwy. 82, Kaplan, LA (US) 70548

( * ) Notice: Subject to any disclaimer, the term of this patent is extended or adjusted under 35 U.S.C. 154(b) by 0 days.

(21) Appl. No.: 10/102,442

(22) Filed: Mar. 21, 2002

(51) Int. Cl.[7] ..... B05B 15/08

(52) U.S. Cl. ..... 239/587.1; 239/280; 239/280.5; 239/722; 239/754; 239/587.2; 239/532

(58) Field of Search ..... 239/722, 754, 239/280, 280.5, 281, 532, 587.1, 587.2, 587.5, 587.6, 166

(56) References Cited

U.S. PATENT DOCUMENTS 2,857,201 A * 10/1958 Palmer ..... 239/281
3,599,866 A 8/1971 Bolton
4,323,196 A * 4/1982 Logue et al. ..... 239/532
4,580,726 A 4/1986 Unger
4,732,325 A 3/1988 Jensen et al.
5,186,392 A * 2/1993 Pleshek ..... 239/532
5,671,887 A 9/1997 Iavarone
D387,852 S 12/1997 Radtke et al.
5,707,014 A 1/1998 Chan et al.
5,833,143 A 11/1998 Hsin-Fa
6,131,831 A 10/2000 Lawrence
6,378,922 B1 * 4/2002 Troudt ..... 239/532
6,540,163 B1 * 4/2003 Huang ..... 239/587.1
6,547,165 B2 * 4/2003 Goodwin et al. ..... 239/532

* cited by examiner

*Primary Examiner*—Robin O. Evans
(74) *Attorney, Agent, or Firm*—Donald R. Schoonover

(57) ABSTRACT

A spray nozzle mechanism includes a fluid conduit which has an operating handle on one end and a spray nozzle unit on another end. A linkage connects the operating handle to the spray nozzle unit to move the spray nozzle unit in response to operation of the operating handle. A stop unit limits the movement of the spray nozzle unit.

2 Claims, 2 Drawing Sheets

MOVABLE SPRAY NOZZLE MECHANISM

BACKGROUND OF THE INVENTION

1. Field of the Invention

The present invention relates to the general art of cleaning with liquids, and to the particular field of cleaning using fluid spraying.

2. Discussion of the Related Art

Many people wash their own cars, as well as the windows and other elements of their homes. These washing processes sometimes use high pressure water sprayed onto the workpiece being washed.

The spraying of water is generally carried out using a garden hose connected to the house water supply. The nozzle of the hose is aimed at the workpiece and water sprayed thereagainst. This works well, but has several disadvantages. For example, if the workpiece is a large vehicle, such as a truck or the like, it may be difficult to reach. some locations on the workpiece. An example of this problem is applying water to the roof of a truck or other such vehicle. A worker may be forced to stand in an awkward position and may get wet if forced to lean against the workpiece. Still further, it may be difficult to spray water on the underside of the workpiece.

Therefore, there is a need for a spray nozzle mechanism that can easily reach areas that may not be accessible to a nozzle of a garden hose.

Still further, a single job may require several different angles of contact between the spray water and the workpiece. For example, dirt can be removed from a surface by spray directed at one angle with respect thereto while other dirt may require a different angle of attack between the spray water and the surface from which the dirt is being removed. Changing the angle of attack between the spray and the workpiece may be difficult and cumbersome.

Therefore, there is a need for a spray nozzle mechanism is that can easily be adjusted even during a spraying action.

One problem with using a hose to clean workpieces such as vehicles is the nozzle often moves into a position and/or orientation that directs spray towards a user. This may be simply an annoyance in some situations, but can be hazardous if cleaning fluid is being applied to the workpiece.

Therefore, there is a need for a spray nozzle mechanism that includes protection from accidentally spraying a user.

In the case of using cleaning fluids, it is often safe practice to space a user away from the spray nozzle. This is not always possible if a hose is being used to supply the water to the process.

Therefore, there is a need for a spray nozzle mechanism that can separate a user from the nozzle spraying the fluid being used in the cleaning process.

PRINCIPAL OBJECTS OF THE INVENTION

It is a main object of the present invention to provide a spray nozzle mechanism that can easily reach areas that may not be accessible to a nozzle of a garden hose.

It is another object of the present invention to provide a spray nozzle mechanism that can easily be adjusted even during a spraying action.

It is another object of the present invention to provide a spray nozzle mechanism that includes protection from accidentally spraying a user.

It is another object of the present invention to provide a spray nozzle mechanism that can separate a user from the nozzle spraying the fluid being used in the cleaning process.

SUMMARY OF THE INVENTION

These, and other, objects are achieved by a spray nozzle mechanism comprising a hollow cylindrical conduit body; a hose connection unit on a proximal end of the conduit body; a stop unit fixed to a distal end of the conduit body and having two spaced apart stop elements; a handle mount fixedly mounted on the conduit body adjacent to the proximal end of the conduit body; a nozzle mount rotatably mounted on the distal end of the conduit body; a spray nozzle mounted on the nozzle mount for rotation therewith; a linkage connecting element fixedly mounted on the nozzle mount for rotation therewith and spaced from the spray nozzle and positioned between the two spaced apart stop elements of the stop unit; a control handle element pivotally mounted on the handle mount; and a linkage arm connecting the control handle element to the linkage connecting element to move the spray nozzle via the nozzle mount and the linkage connecting element in response to movement of the control handle.

The spray nozzle mechanism of the present invention thus spaces the user apart from the nozzle and permits easy adjustment of the nozzle with respect to a workpiece. Thus, otherwise difficult-to-reach areas of a workpiece are easily accessed by the spray nozzle while the user can still manipulate and adjust the spray nozzle into the most effective angle and position with respect to the workpiece. The stop unit of the mechanism also prevents the nozzle from adopting an orientation that might accidentally direct spray toward the user. This is especially useful in situations where the nozzle is located in positions that are not readily visible to the user, such as on top of or under a large vehicle. If the user cannot see the nozzle, he or she may accidentally turn the nozzle into an orientation that sprays the user.

DETAILED DESCRIPTION OF THE INVENTION

Figure 1:
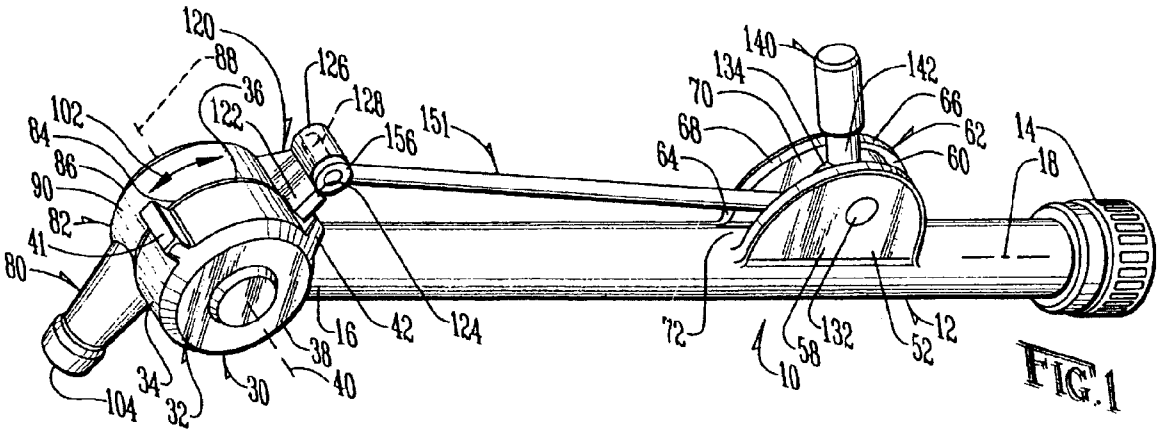
FIG. 1 is a perspective view of the spray nozzle mechanism embodying the present invention.

Other objects, features and advantages of the invention will become apparent from a consideration of the following detailed description and the accompanying drawings.

The spray nozzle mechanism embodying the teaching of the present invention includes a nozzle that is spaced apart from an operating handle and includes a linkage connecting the nozzle to the operating handle so an operator who is spaced from the spray nozzle can easily operate and adjust the orientation of the spray nozzle. The spray nozzle mechanism of the present invention also includes a stop unit to prevent the operator from placing the spray nozzle into an orientation that will direct spray towards the user.

It is noted that the spray nozzle mechanism of the present invention will be disclosed for use with a hose, such as a garden hose. However, other fluid sources can also be used without departing from the scope of the present disclosure as will occur to those skilled in the art based on the teaching of this disclosure. Also, even though not specifically disclosed herein, flow rate control elements can be included on the hose or fluid source as is known to those skilled in the art and fluid mixing systems can also be included without departing from the scope of the present disclosure. Various fluids, including water or in place of or in addition to water, can be used as well.

Referring to the figures, it can be understood that the present invention is embodied in a spray nozzle mechanism 10 which comprises a hollow cylindrical conduit body 12 having a proximal end 14, a distal end 16 and a longitudinal axis 18 extending between proximal end 14 and distal end 16 of conduit body 12. A fluid conducting bore 20 is defined through conduit body 12 from distal end 16 to proximal end 14 of conduit body 12. Conduit body 12 further includes an outer surface 22. Conduit body 12 can be formed of any suitable material, including plastic, and is adapted to be used in conjunction with a source of pressurized fluid, such as a garden hose G, or the like. A hose connection unit 24 is located on proximal end 14 of conduit body 12 and includes an internally threaded coupling 26 rotatably mounted on proximal end 14 of conduit body 12 to releasably couple the nozzle mechanism 10 to the fluid source.

Spray nozzle mechanism 10 further includes a stop unit 30 fixed to distal end 16 of conduit body 12. Stop unit 30 includes a cylindrical body 32 fixedly mounted on outer surface 22 of conduit body 12. An outer surface 34 of the cylindrical body 32 of the stop unit 30 is spaced apart from outer surface 22 of conduit body 12. Cylindrical body 32 of stop unit 30 includes first end 36 which is located adjacent to outer surface 22 of conduit body 12. A second end 38 of cylindrical body 32 of stop unit 30 is spaced apart from first end 36 of cylindrical body 32 of the stop unit 30, and a longitudinal axis 40 extends between the first and second ends 36, 38 of cylindrical body 32 and is oriented at a right angle with respect to longitudinal axis 18 of conduit body 12.

Stop unit 30 further includes a first stop element 41 on outer surface 34 of cylindrical body 32 of the stop unit 30 and a second stop element 42 on outer surface 34 of cylindrical body 32 of stop unit 30. The first and second stop elements 41, 42 of stop unit 30 are spaced apart from each other along outer surface 34 of cylindrical body 32 of stop unit 30.

Spray nozzle mechanism 10 further includes a handle mount unit 50 which includes a first semicircular mounting plate 52 having a linear base 54 fixedly mounted on outer surface 22 of conduit body 12 adjacent to proximal end 14 of conduit body 12 and which extends in the direction of longitudinal axis 18 of conduit body 12. First semicircular mounting plate 52 further includes an arcuate perimeter 56 extending away from outer surface 22 of the conduit body 12, an outer surface 58 and an inner surface 60. Spray nozzle mechanism 10 further includes a second semicircular mounting plate 62 having a linear base 64 fixedly mounted on outer surface 22 of conduit body 12 adjacent to proximal end 14 of conduit body 12 and extends in the direction of longitudinal axis 18 of the conduit body 12. The linear bases 54, 64 of the first and second semicircular mounting plates 52, 62 are spaced apart from each other on outer surface 22 of conduit body 12 and extend parallel to each other.

Second semicircular mounting plate 62 further includes an arcuate perimeter 66 which extends away from outer surface 22 of conduit body 12, an outer surface 68 and an inner surface 70. The inner surfaces 60, 70 of the first and second semicircular mounting plates 52, 62 are spaced apart from each other on outer surface 22 of conduit body 12 and extend parallel to each other and define a gap 72 therebetween. The inner surfaces 60, 70 of the first and second mounting plates 52, 62 are located between the outer surfaces 58, 68 of the first and second semicircular mounting plates 52, 62.

Figure 2:
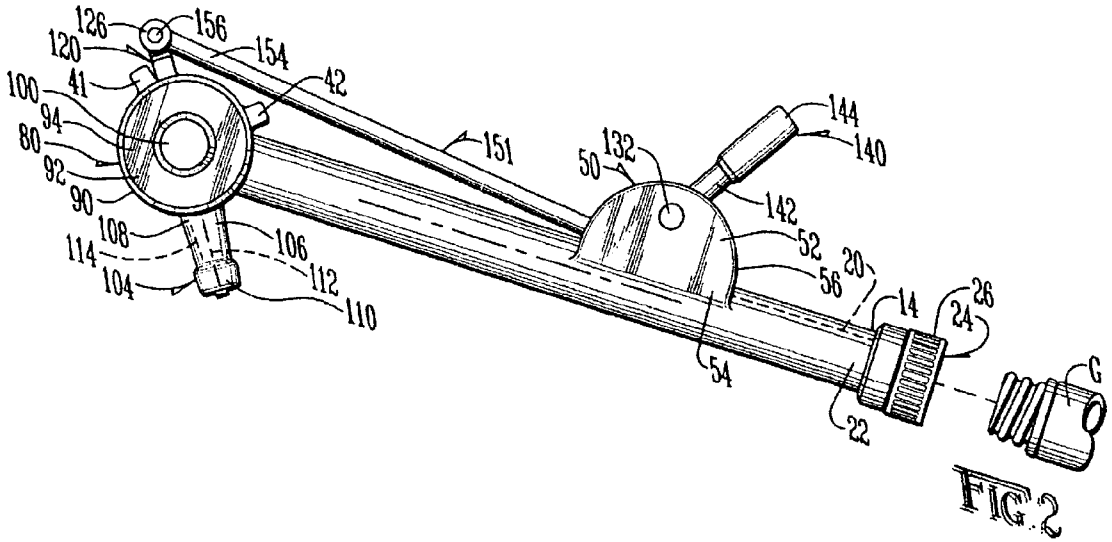
FIG. 2 is a side elevational view of the spray nozzle mechanism.

Spray nozzle mechanism 10 further includes a nozzle unit 80 rotatably mounted on conduit body 12 adjacent to stop unit 30 and includes a cylindrical base 82 having a first end 84 located adjacent to first end 36 of cylindrical body 32 of stop unit 30 and is superimposed therewith. Nozzle unit 80 further includes a second end 86 and a longitudinal axis 88 that extends between the first and second ends 84, 86 of cylindrical base 82 of nozzle unit 80 and is linearly aligned with longitudinal axis 40 of cylindrical body 32 of stop unit 30. Nozzle unit 80 further includes an outer surface 90 extending between the first and second ends 84, 86 of cylindrical base 82 of nozzle unit 80. Cylindrical base 82 of nozzle unit 80 is hollow and defines a fluid chamber 92 which is fluidically connected to fluid conducting bore 20 of conduit body 12 to receive fluid, such as water, from source, such as hose G, via the fluid conducting bore 20. Nozzle unit 80 further includes a face plate 94 fixedly mounted on second end 86 of cylindrical base 82 of nozzle unit 80 and is fixedly connected to outer surface 90 of cylindrical base 82 of nozzle unit 80. First end 84 of cylindrical base 82 is open as indicated in FIG. 2. Nozzle unit 80 further includes a pivot pin 100 mounted on conduit body 12 adjacent to distal end 16, and face plate 94 of nozzle unit 80 is mounted on pivot pin 100 for rotation about pivot pin 100 with outer surface 90 of cylindrical base 82 of nozzle unit 80 rotating with face plate 94. The rotation of the nozzle unit 10 is indicated in FIG. 1 by double-headed arrow 102.

Nozzle unit 80 further includes a spray nozzle 104 mounted on outer surface 90 of cylindrical base 82 for rotation therewith and has a hollow body 106, a proximal end 108 of hollow body 106 of spray nozzle 104 fixedly mounted on outer surface 90 of cylindrical base 82, a distal end 110 of hollow body 106 of the spray nozzle 104 of spray nozzle unit 80, and a longitudinal axis 112 extends between the proximal and the distal ends of the hollow body of spray nozzle 104. A bore 114 extends along longitudinal axis 112 of the spray nozzle 104 from proximal end 108 of the spray nozzle 104 to distal end 110 of the spray nozzle 104. Bore 114 is fluidically connected to fluid chamber 92 defined in cylindrical base 82 of spray nozzle unit 80 to receive fluid therefrom.

Nozzle unit 80 further includes a linkage connecting element 120 fixedly mounted on outer surface 90 of cylindrical base 82 of spray nozzle unit 80 for rotation therewith and at a location spaced apart from spray nozzle 104 and between the first and second stop elements 41, 42 of stop unit 30. Linkage connecting element 120 includes a linear base 122 on outer surface 90 of cylindrical base 82 of spray nozzle unit 80 and extends in the direction of longitudinal axis 88 of cylindrical base 82. Linear base 122 extends over outer surface 34 of stop unit 30 from first end 36 of cylindrical body 32 of stop unit 30 to second end 38 of cylindrical body 32 of stop unit 30 to be adjacent to outer surface 34 of cylindrical body 32 of stop unit 30. Linkage connecting element 120 further includes a distal end 124 spaced from base 122 of linkage connecting element 120 and which extends in the direction of linear base 122 of linkage connecting element 120. A cylindrical housing 126 is fixed to distal end 124 of linkage connecting element 120 of nozzle unit 80 and includes a hollow bore 128.

Figures 3A, 3B:
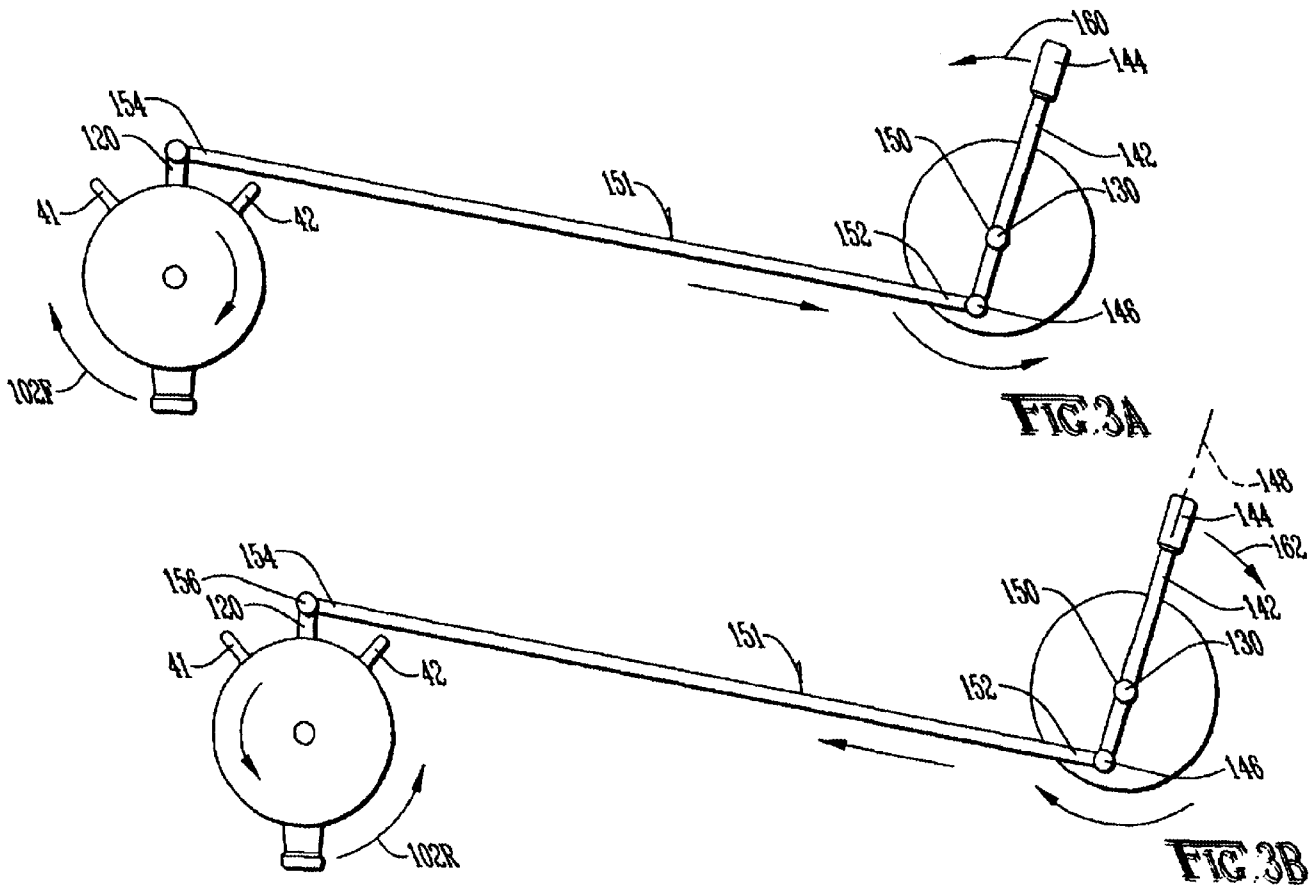
FIG. 3A is a schematic illustrating the linkage connection between an operating handle and a spray nozzle unit with force being applied to the operating handle in one direction.
FIG. 3B is a schematic illustrating the linkage connection between the operating handle and the spray nozzle with force being applied to the operating handle in another direction, according to the present invention.

Handle mount unit 50 further includes a linkage pivot pin 130 having a first end 132 fixedly mounted on first semicircular mounting plate 52 of handle mount unit 50, a second end 134 fixedly mounted on second semicircular mounting plate 62 of handle mount unit 50 and spans gap 72 defined between the inner surfaces of the first and second semicircular mounting plates 52, 62. As shown in FIGS. 3A and 3B, a control handle element 140 includes a body 142 which has a distal end 144, a proximal end 146 and a longitudinal axis 148 extending between the distal and proximal ends 144, 146 of body 142. Control handle element 140 includes a pivotal connection 150 located between the distal and proximal ends 144, 146 of body 142 of control handle element 140 and is pivotally connected to linkage pivot pin 130.

As shown in FIGS. 3A and 3B, proximal end 146 of body 142 of control handle element 140 is located between linkage pivot pin 130 and outer surface 22 of conduit body 12. The arcuate perimeters 56, 66 of the first and second semicircular mounting plates 52, 62 of handle mount unit 50 are located between distal end 144 of body 142 of control handle element 140 and pivot pin 130. As indicated in FIGS. 3A and 3B, body 142 of control handle element 140 pivotally moves about linkage pivot pin 130 when force is applied to distal end 144 of body 142 of control handle element 140.

Nozzle spray mechanism 10 further includes a linkage arm 151 which includes a proximal end 152 fixedly connected to proximal end 146 of body 142 of control handle element 140 for movement therewith. Linkage arm 150 includes a distal end 154. A cylindrical bearing element 156 is fixedly connected to distal end 154 of linkage arm 150. Cylindrical bearing element 156 is rotatably mounted in cylindrical housing 126 of linkage connecting element 120 of nozzle unit 80.

As indicated in FIGS. 3A and 3B, linkage arm 150 transfers movement of proximal end 152 of the linkage arm 151 to spray nozzle unit 80 via cylindrical bearing element 156 on distal end 154 of linkage arm 150 and cylindrical housing 126 of linkage connecting element 120 of nozzle unit 80 to rotate nozzle unit 80 about pivot pin 100 of cylindrical base 82 of nozzle unit 80 when force is applied to distal end 144 of body 142 of control handle element 140.

As indicated in FIG. 3A, when force is applied to the distal end of the handle in direction 160, the nozzle will move in direction 102F and, as indicated in FIG. 3B, when force is applied to the distal end of the handle in direction 162, the nozzle will move in direction 102R whereby a user can control the direction of the nozzle and the direction of spray from the nozzle. Since the stop unit 30 is stationary with respect to the conduit body 12, stop elements 41, 42 are stationary with respect to nozzle unit 80. Since linkage connecting element 120 is located between the two stop elements 41, 42 and extends over the outer surface of the stop element base, that linkage connecting element 120 will abut the stop elements 41, 42 when it has moved a predetermined distance with respect to the conduit body 12. The stop elements 41, 42 are located to prevent the nozzle from being directed back toward the user holding hose G or too far in front of that user.

It is understood that while certain forms of the present invention have been illustrated and described herein, it is not to be limited to the specific forms or arrangements of parts described and shown.

I claim:

1. A spray nozzle mechanism comprising:

a) a hollow cylindrical conduit body having
  (1) a proximal end,
  (2) a distal end,
  (3) a longitudinal axis extending between the proximal end and the distal end of the conduit body,
  (4) a fluid conducting bore defined through said conduit body from the distal end of said conduit body to the proximal end of said conduit body, and
  (5) an outer surface on said conduit body;

b) a hose connection unit on the proximal end of said conduit body and which includes an internally threaded coupling rotatably mounted on the proximal end of said conduit body;

c) a stop unit fixed to the distal end of said conduit body and including
  (1) a cylindrical body fixedly mounted on the outer surface of said conduit body,
  (2) an outer surface on the cylindrical body of said stop unit,
  (3) the outer surface of the cylindrical body of said stop unit being spaced apart from the outer surface of said conduit body,
  (4) a first end on the cylindrical body of said stop unit,
  (5) the first end of the cylindrical body of said stop unit being located adjacent to the outer surface of said conduit body,
  (6) a second end of the cylindrical body of said stop unit which is spaced apart from the first end of the cylindrical body of said stop unit,
  (7) a longitudinal axis extending between the first and second ends of the cylindrical body of said stop unit and being oriented at a right angle with respect to the longitudinal axis of said conduit body,
  (8) a first stop element on the outer surface of the cylindrical body of said stop unit,
  (9) a second stop element on the outer surface of the cylindrical body of said stop element, and
  (10) the first and second stop elements of said stop unit being spaced apart from each other along the outer surface of the cylindrical body of said stop element;

d) a handle mount unit which includes
  (1) a first semicircular mounting plate having
    (A) a linear base fixedly mounted on the outer surface of said conduit body adjacent to the proximal end of said conduit body and extending in the direction of the longitudinal axis of said conduit body,
    (B) an arcuate perimeter extending away from the outer surface of said conduit body,
    (C) an outer surface, and
    (D) an inner surface,
  (2) a second semicircular mounting plate having
    (A) a linear base fixedly mounted on the outer surface of said conduit body adjacent to the proximal end of said conduit body and extending in the direction of the longitudinal axis of said conduit body,
    (B) the linear bases of the first and second semicircular mounting plates being spaced apart from each other on the outer surface of said conduit body and extending parallel to each other,
    (C) an arcuate perimeter extending away from the outer surface of said conduit body,
    (D) an outer surface,
    (E) an inner surface,
    (F) the inner surfaces of the first and second semicircular mounting plates being spaced apart from each other on the outer surface of said conduit body and extending parallel to each other and defining a gap therebetween, and (G) the inner surfaces of the first and second mounting plates being located between the outer surfaces of the first and second semicircular mounting plates;

e) a nozzle unit rotatably mounted on said conduit body adjacent to said stop unit and including (1) a cylindrical base having (A) a first end located adjacent to the first end of the cylindrical body of said stop unit and being superimposed therewith, (B) a second end, (C) a longitudinal axis extending between the first and second ends of the cylindrical base of said nozzle unit and being linearly aligned with the longitudinal axis of the cylindrical body of said stop unit, (D) an outer surface extending between the first and second ends of the cylindrical base of said nozzle unit, (E) the cylindrical base of said nozzle unit being hollow and defining a fluid chamber which is fluidically connected to the fluid conducting bore of said conduit body, (F) a face plate fixedly mounted on the second end of the cylindrical base of said nozzle unit and fixedly connected to the outer surface of the cylindrical base of said nozzle unit, (G) the first end of the cylindrical base of said nozzle unit being open, (H) a pivot pin mounted on said conduit body adjacent to the distal end of said conduit body, and (I) the face plate of the cylindrical body of said nozzle unit being mounted on the pivot pin of said nozzle unit for rotation about the pivot pin with the outer surface of the cylindrical base of said nozzle unit rotating with the face plate of the cylindrical base of said spray nozzle unit, (2) a spray nozzle mounted on the outer surface of the cylindrical base of said spray nozzle unit for rotation therewith and having (A) a hollow body, (B) a proximal end of the hollow body of the spray nozzle fixedly mounted on the outer surface of the cylindrical base of said spray nozzle unit, (C) a distal end of the hollow body of the spray nozzle of said spray nozzle unit, (D) a longitudinal axis extending between the proximal and the distal ends of the hollow body of the spray nozzle of said spray nozzle unit, (E) a bore extending along the longitudinal axis of the spray nozzle from the proximal end of the spray nozzle to the distal end of the spray nozzle, and (F) the bore of the spray nozzle being fluidically connected to the fluid chamber defined in the cylindrical base of said spray nozzle unit, and (3) a linkage connecting element fixedly mounted on the outer surface of the cylindrical base of said spray nozzle unit for rotation therewith and at a location spaced apart from the spray nozzle of said spray nozzle unit and between the first and second stop elements of said stop unit and which includes (A) a linear base on the outer surface of the cylindrical base of said spray nozzle unit and extending in the direction of the longitudinal axis of the cylindrical base of said spray nozzle unit and over the outer surface of the cylindrical body said stop unit from the first end of the cylindrical body of said stop unit to the second end of the cylindrical body of said stop unit to be adjacent to the outer surface of the cylindrical body of said stop unit, (B) a distal end spaced from the base of the linkage connecting element of said nozzle unit and which extends in the direction of the linear base of the linkage connecting element, and (C) a cylindrical housing fixed to the distal end of the linkage connecting element of said nozzle unit and which includes a hollow bore;

f) a linkage pivot pin (1) having a first end fixedly mounted on the first semicircular mounting plate of said handle mount unit, (2) having a second end fixedly mounted on the second semicircular mounting plate of said handle mount unit, and (3) spanning the gap defined between the inner surfaces of the first and second semicircular mounting plates of said handle mount unit;

g) a control handle element which includes (1) a body, (2) a distal end of the body of said control handle element, (3) a proximal end of the body of said control handle element, (4) a longitudinal axis extending between the distal and proximal ends of the body of said control handle element, (5) a pivotal connection located between the distal and proximal ends of the body of said control handle element and which is pivotally connected to said linkage pivot pin, (6) the proximal end of the body of said control handle element being located between said linkage pivot pin and the outer surface of said conduit body, and the arcuate perimeters of the first and second semicircular mounting plates of said handle mount unit being located between the distal end on the body of said control handle element and said pivot pin, and (7) the body of said control handle element pivotally moving about said linkage pivot pin when force is applied to the distal end of the body of said control handle element; and h) a linkage arm which includes (1) a proximal end fixedly connected to the proximal end on the body of said control handle element for movement therewith, (2) a distal end, (3) a cylindrical bearing element fixedly connected to the distal end of said linkage arm, (4) the cylindrical bearing element of said linkage arm being rotatably mounted in the cylindrical housing of said linkage connecting element of said nozzle unit, and (5) said linkage arm transferring movement of the proximal end of said linkage arm to said spray nozzle unit via the cylindrical bearing element on the distal end of said linkage arm and the cylindrical housing of the linkage connecting element of said nozzle unit to rotate said nozzle unit about the pivot pin of the cylindrical base of said nozzle unit when force is applied to the distal end of the body of said control handle element.

2. A spray-nozzle mechanism comprising:

a) a hollow cylindrical conduit body;

b) a hose connection unit on a proximal end of said conduit body;

c) a stop unit fixed to a distal end of said conduit body and having two spaced apart stop elements;

d) a handle mount fixedly mounted on said conduit body adjacent to the proximal end of said conduit body;

e) a nozzle mount rotatably mounted on the distal end of said conduit body;

f) a spray nozzle mounted on said nozzle mount for rotation therewith;

g) a linkage connecting element fixedly mounted on said nozzle mount for rotation therewith and spaced from said spray nozzle and positioned between the two spaced apart stop elements of said stop unit;

h) a control handle element pivotally mounted on said handle mount; and i) a linkage arm connecting said control handle element to said linkage connecting element to move said spray nozzle via said nozzle mount and said linkage connecting element in response to movement of said control handle.

* * * * *